US009695819B2

(12) United States Patent
Ogata et al.

(10) Patent No.: US 9,695,819 B2
(45) **Date of Patent: *Jul. 4, 2017**

(54) ROTARY COMPRESSOR WITH CYLINDER IMMERSED IN OIL

(71) Applicant: Panasonic Corporation, Kadoma-shi, Osaka (JP)

(72) Inventors: Takeshi Ogata, Osaka (JP); Yu Shiotani, Osaka (JP); Takumi Hikichi, Osaka (JP); Kentaro Shii, Osaka (JP); Tadayoshi Shoyama, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 371 days.

This patent is subject to a terminal disclaimer.

(21) Appl. No.: 14/367,626

(22) PCT Filed: Nov. 14, 2012

(86) PCT No.: PCT/JP2012/007306

§ 371 (c)(1),
(2) Date: Jun. 20, 2014

(87) PCT Pub. No.: WO2013/094114

PCT Pub. Date: Jun. 27, 2013

(65) Prior Publication Data

US 2015/0233376 A1 Aug. 20, 2015

(30) Foreign Application Priority Data

Dec. 22, 2011 (JP) ..... 2011-281230
Aug. 10, 2012 (JP) ..... 2012-177879

(51) Int. Cl.
*F04C 18/356* (2006.01)
*F04C 23/00* (2006.01)
(Continued)

(52) U.S. Cl.
CPC ..... *F04C 18/356* (2013.01); *F04C 23/001* (2013.01); *F04C 23/008* (2013.01);
(Continued)

(58) Field of Classification Search
CPC ..... F04C 18/356; F04C 29/02; F04C 29/028; F04C 29/04; F04C 29/047; F04C 29/126;
(Continued)

(56) References Cited

U.S. PATENT DOCUMENTS 5,230,616 A 7/1993 Serizawa et al.
5,242,280 A 9/1993 Fujio
(Continued)

FOREIGN PATENT DOCUMENTS

CN 101684814 3/2010
CN 101835987 9/2010
(Continued)

OTHER PUBLICATIONS

Search Report issued in corresponding Chinese Patent Application No. 201280056562.7, Sep. 2, 2015, 4 pages with and English translation.
(Continued)

*Primary Examiner* — Mary A Davis
(74) *Attorney, Agent, or Firm* — Hamre, Schumann, Mueller & Larson, P.C.

(57) ABSTRACT

A rotary compressor (100) includes a closed casing (1), a cylinder (15), a piston (28), a lower bearing member (7), a vane (33), a suction port, a discharge port (41), and a partition member (10). The partition member (10) is attached to a second principal surface (7*a*) of the lower bearing member (7) located on the opposite side to the cylinder (15) so as to form a refrigerant discharge space (52) serving as a flow path of a refrigerant discharged from a discharge chamber through the discharge port (41). The
(Continued)

refrigerant discharge space (52) is limited so that a region where the refrigerant discharge space (52) is not present is formed on the same side as the suction port with respect to a first reference plane, and in that region, the second principal surface (7*a*) of the lower bearing member (7) is in contact with an oil in an oil reservoir (22) directly or via the partition member (10).

7 Claims, 11 Drawing Sheets

(51) Int. Cl.
*F04C 29/04* (2006.01)
*F04C 29/02* (2006.01)
*F04C 29/12* (2006.01)
*F04C 29/00* (2006.01)

(52) U.S. Cl.
CPC ..... *F04C 29/0042* (2013.01); *F04C 29/02* (2013.01); *F04C 29/028* (2013.01); *F04C 29/04* (2013.01); *F04C 29/12* (2013.01)

(58) Field of Classification Search
CPC .. F04C 23/001; F04C 23/008; F04C 2240/50; F04C 2240/809
See application file for complete search history.

(56) References Cited

U.S. PATENT DOCUMENTS 5,322,424 A * 6/1994 Fujio ..... F04C 23/001 418/11
7,722,343 B2 * 5/2010 Hirayama ..... F04C 18/356 184/6.16
8,342,825 B2 1/2013 Byun et al.
2008/0112831 A1 5/2008 Ogasawara
2008/0145252 A1 * 6/2008 Ku ..... F04C 23/001 418/54
2009/0068046 A1 3/2009 Kishikawa et al.
2009/0297382 A1 12/2009 Okaichi
2010/0215525 A1 8/2010 Ogasawara et al.
2010/0226796 A1 9/2010 Kanayama
2010/0269536 A1 * 10/2010 Wada ..... F04C 18/356 62/402
2014/0301881 A1 * 10/2014 Ogata ..... F04C 29/04 418/63
2014/0322057 A1 * 10/2014 Ogata ..... F04C 23/008 418/64

FOREIGN PATENT DOCUMENTS

| | | |
|---|---|---|
| EP | 1 967 737 | 9/2008 |
| EP | 2 034 131 | 3/2009 |
| JP | 64-000387 | 1/1989 |
| JP | 2-140486 | 5/1990 |
| JP | 4-171279 | 6/1992 |
| JP | 9-158884 | 6/1997 |
| JP | 10-103273 | 4/1998 |
| JP | 2005-256816 | 9/2005 |
| JP | 2007-309146 | 11/2007 |
| JP | 2009-002298 | 1/2009 |
| JP | 2009-002299 | 1/2009 |
| JP | 2012-122452 | 6/2012 |

OTHER PUBLICATIONS

Search Report issued in corresponding Chinese Patent Application No. 201280056574.X, Sep. 21, 2015, 4 pages with translation.
Extended European Search Report issued in the corresponding European Patent Application No. 12849536.3 dated Apr. 7, 2015.

* cited by examiner

ROTARY COMPRESSOR WITH CYLINDER IMMERSED IN OIL

TECHNICAL FIELD

The present invention relates to rotary compressors.

BACKGROUND ART

Rotary compressors are widely used in electrical appliances such as air conditioners, heaters, and hot water dispensers. As one approach to improve the efficiency of rotary compressors, there has been proposed a technique for suppressing so-called heat loss, i.e., a decrease in efficiency caused by the fact that a refrigerant drawn into a compression chamber (a drawn refrigerant) receives heat from the environment.

A rotary compressor of Patent Literature 1 has a closed space provided in a suction-side portion of a cylinder as a means for suppressing heat reception by a drawn refrigerant. The closed space suppresses heat transfer from a high-temperature refrigerant in a closed casing to the inner wall of the cylinder.

CITATION LIST

Patent Literature

Patent Literature 1: JP 02(1990)-140486 A

SUMMARY OF INVENTION

Technical Problem

However, it is not necessarily easy to form a closed space in a cylinder as in Patent Literature 1. Therefore, another technique capable of effectively suppressing heat reception by a drawn refrigerant has been desired.

Solution to Problem

The present disclosure provides a rotary compressor including:

a closed casing having an oil reservoir;

a cylinder disposed inside the closed casing so as to be immersed in the oil reservoir;

a piston disposed inside the cylinder;

a bearing member disposed above or below the cylinder so as to form a cylinder chamber between the cylinder and the piston, the bearing member having a first principal surface that is in contact with the cylinder and a second principal surface that is opposite to the first principal surface;

a vane that partitions the cylinder chamber into a suction chamber and a discharge chamber;

a suction port though which a refrigerant to be compressed is introduced into the suction chamber;

a discharge port through which the compressed refrigerant is discharged from the discharge chamber, the discharge port being formed in the bearing member; and a partition member attached to the second principal surface of the bearing member so as to form, together with the bearing member, a refrigerant discharge space capable of retaining the refrigerant discharged from the discharge chamber through the discharge port.

In this rotary compressor, when (i) a plane including a central axis of the cylinder and a center of the vane when the vane protrudes maximally toward the central axis of the cylinder is defined as a first reference plane, (ii) a plane including the central axis and perpendicular to the first reference plane is defined as a second reference plane, and (iii) four segments obtained by dividing the rotary compressor by the first reference plane and the second reference plane are defined as a first quadrant segment including the suction port, a second quadrant segment including the discharge port, a third quadrant segment opposite to the first quadrant segment and adjacent to the second quadrant segment, and a fourth quadrant segment opposite to the second quadrant segment and adjacent to the first quadrant segment, respectively, the refrigerant discharge space falls within a combined region consisting of a region corresponding to the first quadrant segment, a region corresponding to the second quadrant segment, and a region corresponding to the third quadrant segment, and the second principal surface of the bearing member is in contact with an oil in the oil reservoir directly or via the partition member over an extended region defined by extending a region corresponding to the fourth quadrant segment circumferentially around the central axis to the refrigerant discharge space.

Advantageous Effects of Invention

According to the above rotary compressor, the refrigerant discharge space is limited so that a region where the refrigerant discharge space is not present is formed on the same side as the suction port with respect to the first reference plane, and in that region, the second principal surface of the bearing member located on the opposite side to the cylinder is in contact with the oil in the oil reservoir. With such a configuration, it is possible to reduce the cross-sectional area of a heat transfer path from the discharged refrigerant to the drawn refrigerant and to increase the distance over which the heat is transferred. Therefore, it is possible to suppress the heat transfer from the compressed refrigerant to the drawn refrigerant through the bearing member.

DESCRIPTION OF EMBODIMENTS

Figure 1:
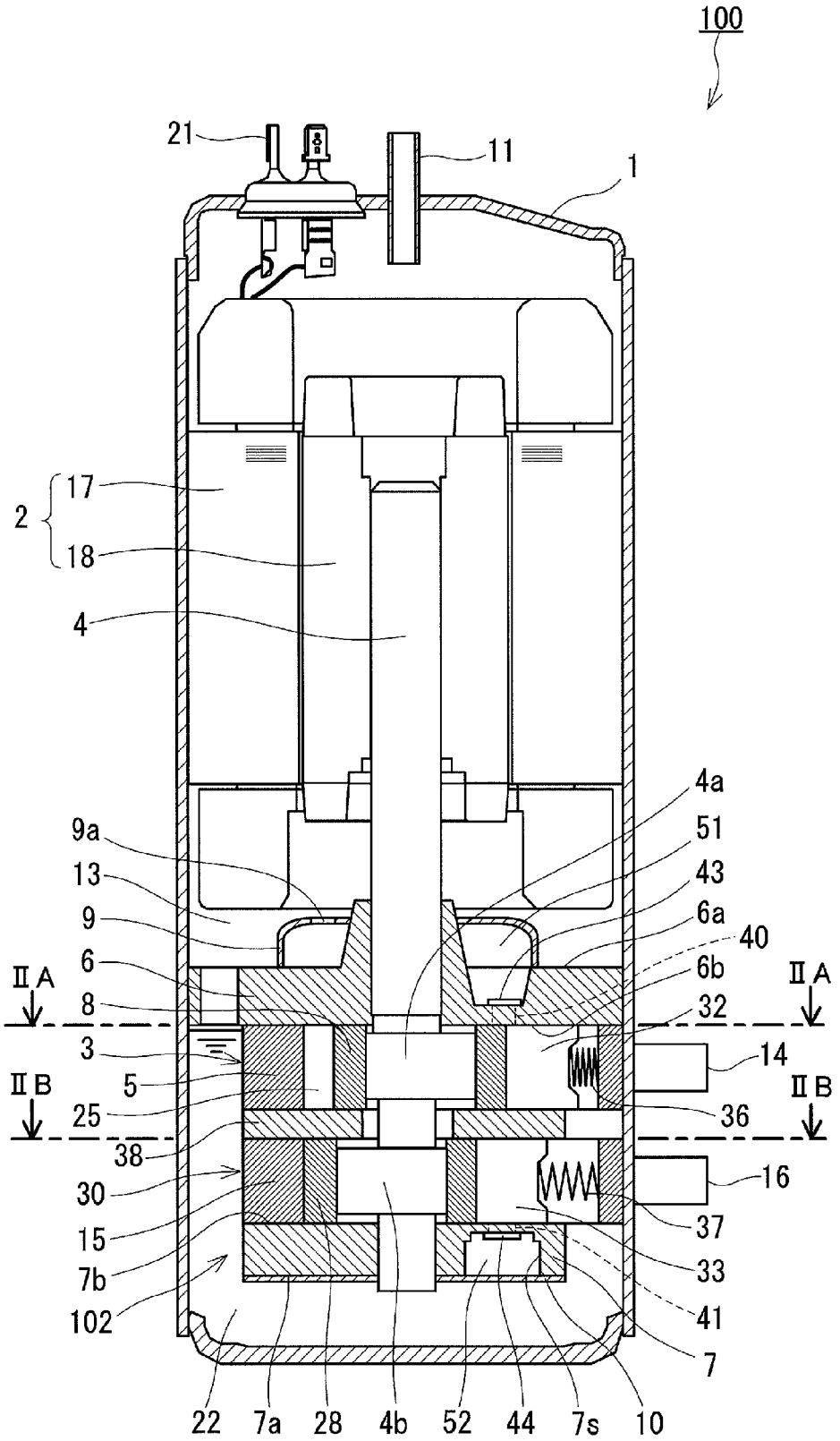
FIG. 1 is a longitudinal cross-sectional view of a rotary compressor according to a first embodiment of the present invention.

A first aspect of the present disclosure provides a rotary compressor including:

a closed casing having an oil reservoir;

a cylinder disposed inside the closed casing so as to be immersed in the oil reservoir;

a piston disposed inside the cylinder;

a bearing member disposed above or below the cylinder so as to form a cylinder chamber between the cylinder and the piston, the bearing member having a first principal surface that is in contact with the cylinder and a second principal surface that is opposite to the first principal surface;

a vane that partitions the cylinder chamber into a suction chamber and a discharge chamber;

a suction port through which a refrigerant to be compressed is introduced into the suction chamber;

a discharge port through which the compressed refrigerant is discharged from the discharge chamber, the discharge port being formed in the bearing member; and a partition member attached to the second principal surface of the bearing member so as to form, together with the bearing member, a refrigerant discharge space capable of retaining the refrigerant discharged from the discharge chamber through the discharge port.

In this rotary compressor, when (i) a plane including a central axis of the cylinder and a center of the vane when the vane protrudes maximally toward the central axis of the cylinder is defined as a first reference plane, (ii) a plane including the central axis and perpendicular to the first reference plane is defined as a second reference plane, and (iii) four segments obtained by dividing the rotary compressor by the first reference plane and the second reference plane are defined as a first quadrant segment including the suction port, a second quadrant segment including the discharge port, a third quadrant segment opposite to the first quadrant segment and adjacent to the second quadrant segment, and a fourth quadrant segment opposite to the second quadrant segment and adjacent to the first quadrant segment, respectively, the refrigerant discharge space falls within a combined region consisting of a region corresponding to the first quadrant segment, a region corresponding to the second quadrant segment, and a region corresponding to the third quadrant segment, and the second principal surface of the bearing member is in contact with an oil in the oil reservoir directly or via the partition member over an extended region defined by extending a region corresponding to the fourth quadrant segment circumferentially around the central axis to the refrigerant discharge space.

A second aspect of the present disclosure provides the rotary compressor according to the first aspect, wherein the second principal surface of the bearing member is a plane, and a recess into which the discharge port opens is formed in the second principal surface, the recess having a depth larger than a half of a distance between the first principal surface and the second principal surface. Such a configuration is desirable from the viewpoint of providing a thermal barrier layer made of the material (usually a metal) of the bearing member through the use of the thickness of the bearing member.

A third aspect of the present disclosure provides the rotary compressor according to the first aspect, wherein a recess into which the discharge port opens is formed in the second principal surface of the bearing member, and a cutout is formed in the second principal surface on the opposite side to the recess with respect to the central axis. The cutout thus formed reduces the thickness of the bearing member, and thus reduces the weight of the bearing member.

A fourth aspect of the present disclosure provides the rotary compressor according to the second or third aspect, wherein the partition member includes a single plate-like member, and the recess formed in the second principal surface is closed by the partition member so as to form the refrigerant discharge space. This structure is very simple and therefore an increase in the number of components can be avoided.

A fifth aspect of the present disclosure provides the rotary compressor according to the first aspect, wherein the bearing member is disposed below the cylinder and includes a circular plate portion that defines the first principal surface and the second principal surface and a protruding portion that protrudes downward at a center of the circular plate portion, and the partition member has a shape enclosing the discharge port together with a space facing the second principal surface of the bearing member, and the space enclosed by the bearing member and the partition member constitutes the refrigerant discharge space. With such a structure, it is possible to limit the refrigerant discharge space and thus to allow the second principal surface of the bearing member to be in contact with the oil in the oil reservoir directly or via the partition member, while the bearing member having the same structure as a bearing member for a conventional rotary compressor is used.

A sixth aspect of the present disclosure provides the rotary compressor according to any one of the first to fifth aspects, wherein when (a) a plane including the central axis and a center of the suction port is defined as a third reference plane, (b) one of two segments obtained by dividing the rotary compressor by the first reference plane is defined as a first high-temperature segment including the discharge port, (c) one of two segments obtained by dividing the rotary compressor by the third reference plane is defined as a second high-temperature segment including the discharge port, and (d) three of four segments obtained by dividing the rotary compressor by the first reference plane and the third reference plane are collectively defined as a combined high-temperature segment, the three segments being included in the first high-temperature segment or the second high-temperature segment, in a projection view obtained by projecting the combined high-temperature segment and the refrigerant discharge space onto a plane perpendicular to the central axis, 70% or more of a region corresponding to the refrigerant discharge space overlaps a region corresponding to the combined high-temperature segment. With such a configuration, the total loss including heat reception by the drawn refrigerant (heat loss) and pressure loss can be minimized.

A seventh aspect of the present disclosure provides the rotary compressor according to any one of the first to sixth aspects, wherein the rotary compressor further includes a shaft to which the piston is fitted. This rotary compressor can be a vertical rotary compressor in which a rotational axis of the shaft is parallel to a direction of gravity and the oil reservoir is formed at a bottom of the closed casing. In the vertical rotary compressor, the oil in the oil reservoir is less likely to be affected by swirling flow generated by a motor that drives the shaft.

Hereinafter, embodiments of the present invention will be described with reference to the drawings. The present invention is not limited to the embodiments given below.

(First Embodiment)

As shown in FIG. 1, a rotary compressor 100 of the present embodiment includes a closed casing 1, a motor 2, a compression mechanism 102, and a shaft 4. The compression mechanism 102 is disposed in the lower part of the closed casing 1. The motor 2 is disposed above the compression mechanism 102 inside the closed casing 1. The compression mechanism 102 and the motor 2 are coupled together by the shaft 4. A terminal 21 for supplying electric power to the motor 2 is provided on the upper part of the closed casing 1. An oil reservoir 22 for holding lubricating oil is formed at the bottom of the closed casing 1.

The motor 2 is composed of a stator 17 and a rotor 18. The stator 17 is fixed to the inner wall of the closed casing 1. The rotor 18 is fixed to the shaft 4, and rotates together with the shaft 4.

A discharge pipe 11 is provided in the upper part of the closed casing 1. The discharge pipe 11 penetrates the upper part of the closed casing 1, and opens into an internal space 13 of the closed casing 1. The discharge pipe 11 serves as a discharge flow path for discharging the refrigerant compressed in the compression mechanism 102 to the outside of the closed casing 1. During the operation of the rotary compressor 100, the internal space 13 of the closed casing 1 is filled with the compressed refrigerant.

The compression mechanism 102 is driven by the motor 2 to compress the refrigerant. Specifically, the compression mechanism 102 has a first compression block 3, a second compression block 30, an upper bearing member 6, a lower bearing member 7, an intermediate plate 38, a first partition member 9 (a first muffler or a first closing member), and a second partition member 10 (a second muffler or a second closing member). The refrigerant is compressed in the first compression block 3 or the second compression block 30. The first compression block 3 and the second compression block 30 are immersed in the oil stored in the oil reservoir 22. In the present embodiment, the first compression block 3 is composed of the same components as those of the second compression block 30. Therefore, the first compression block 3 has the same suction volume as that of the second compression block 30.

Figure 2A:
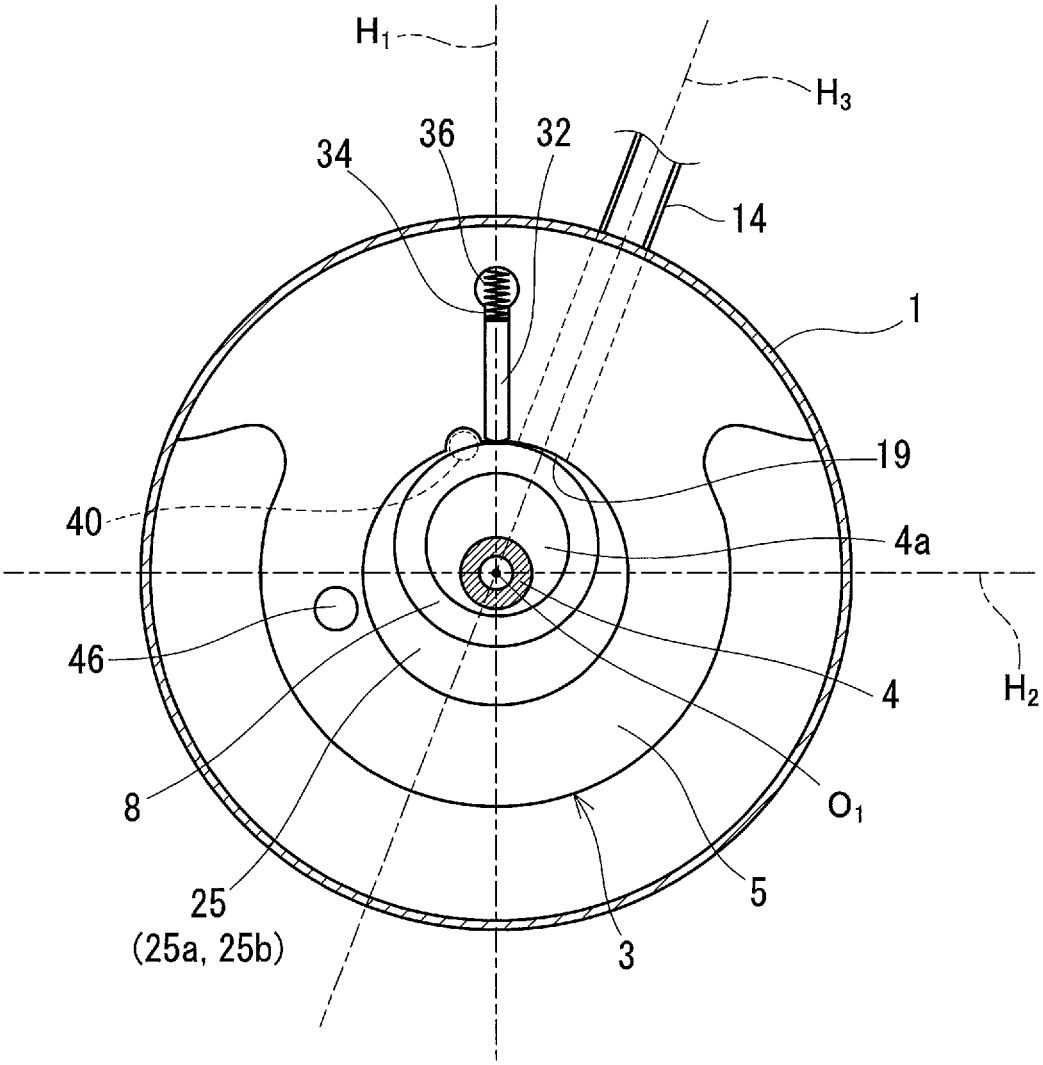
FIG. 2A is a transverse cross-sectional view of the rotary compressor shown in FIG. 1 taken along the line IIA-IIA.
Figure 2B:
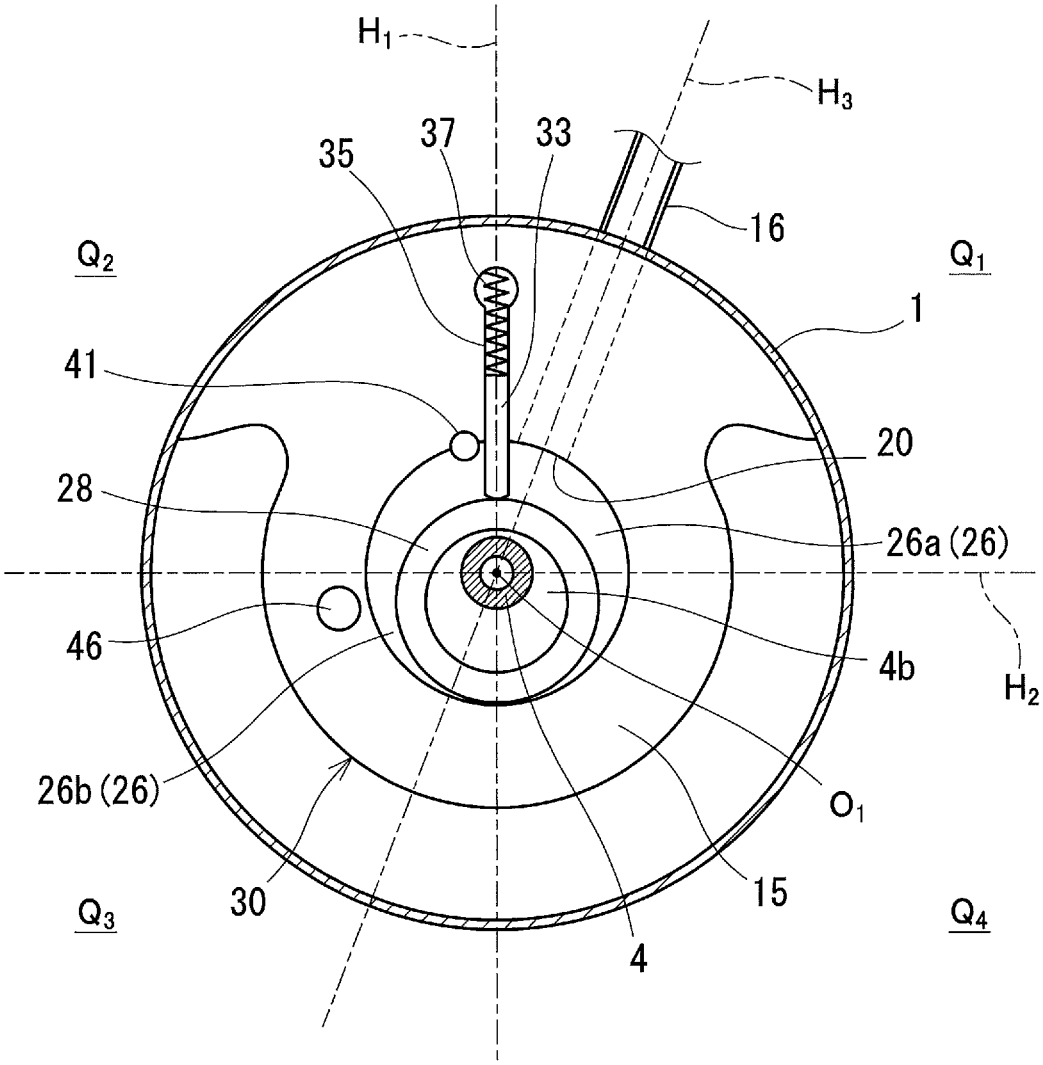
FIG. 2B is a transverse cross-sectional view of the rotary compressor shown in FIG. 1 taken along the line IIB-IIB.

As shown in FIG. 2A, the first compression block 3 is composed of a first cylinder 5, a first piston 8, a first vane 32, a first suction port 19, a first discharge port 40, and a first spring 36. As shown in FIG. 2B, the second compression block 30 is composed of a second cylinder 15, a second piston 28, a second vane 33, a second suction port 20, a second discharge port 41, and a second spring 37. The first cylinder 5 and the second cylinder 15 are disposed vertically and concentrically.

The shaft 4 has a first eccentric portion 4*a* and a second eccentric portion 4*b*. The eccentric portions 4*a* and 4*b* each protrude radially outward. The first piston 8 and the second piston 28 are disposed inside the first cylinder 5 and the second cylinder 15, respectively. In the first cylinder 5, the first piston 8 is fitted to the first eccentric portion 4*a*. In the second cylinder 15, the second piston 28 is fitted to the second eccentric portion 4*b*. A first vane groove 34 and a second vane groove 35 are formed in the first cylinder 5 and the second cylinder 15, respectively. In the rotational direction of the shaft 4, the position of the first vane groove 34 coincides with the position of the second vane groove 35. The first eccentric portion 4*a* protrudes in a direction 180 degrees opposite to the direction in which the second eccentric portion 4*b* protrudes. That is, the phase difference between the first piston 8 and the second piston 28 is 180 degrees. This configuration is effective in reducing vibration and noise.

The upper bearing member 6 is disposed above the first cylinder 5 so as to form a first cylinder chamber 25 between the inner circumferential surface of the first cylinder 5 and the outer circumferential surface of the first piston 8. The lower bearing member 7 is disposed below the second cylinder 15 so as to form a second cylinder chamber 26 between the inner circumferential surface of the second cylinder 15 and the outer circumferential surface of the second piston 28. More specifically, the upper bearing member 6 is attached to the upper surface of the first cylinder 5, and the lower bearing member 7 is attached to the lower surface of the second cylinder 15. The intermediate plate 38 is disposed between the first cylinder 5 and the second cylinder 15. The upper bearing member 6 has a first principal surface 6*b* that is in contact with the first cylinder 5 and a second principal surface 6*a* that is opposite to the first principal surface 6*b* and parallel to the first principal surface 6*b*. The lower bearing member 7 has a first principal surface 7*b* that is in contact with the second cylinder 15 and a second principal surface 7*a* that is opposite to the first principal surface 7*b* and parallel to the first principal surface 7*b*.

The first suction port 19 and the second suction port 20 are formed in the first cylinder 5 and the second cylinder 15, respectively. The first suction port 19 and the second suction port 20 open into the first cylinder chamber 25 and the second cylinder chamber 26, respectively. A first suction pipe 14 and a second suction pipe 16 are connected to the first suction port 19 and the second suction port 20, respectively.

The first discharge port 40 and the second discharge port 41 are formed in the upper bearing member 6 and the lower bearing member 7, respectively. The first discharge port 40 and the second discharge port 41 open into the first cylinder chamber 25 and the second cylinder chamber 26, respectively. The first discharge port 40 is provided with a first discharge valve 43 so as to open and close the first discharge port 40. The second discharge port 41 is provided with a second discharge valve 44 so as to open and close the second discharge port 41.

A first vane 32 (blade) is slidably fitted in the first vane groove 34. The first vane 32 partitions the first cylinder chamber 25 in the circumferential direction of the first piston 8. That is, the first cylinder chamber 25 is partitioned into a first suction chamber 25*a* and a first discharge chamber 25*b*. A second vane 33 (blade) is slidably fitted in the second vane groove 35. The second vane 33 partitions the second cylinder chamber 26 in the circumferential direction of the second piston 28. That is, the second cylinder chamber 26 is partitioned into a second suction chamber 26*a* and a second discharge chamber 26*b*. The first suction port 19 is located on one side of the first vane 32 and the first discharge port 40 is located on the other side thereof. The second suction port 20 is located on one side of the second vane 33 and the second discharge port 41 is located on the other side thereof. The refrigerant to be compressed is supplied to the first cylinder chamber 25 (first suction chamber 25*a*) through the first suction port 19. The refrigerant to be compressed is supplied to the second cylinder chamber 26 (second suction chamber 26*a*) through the second suction port 20. The refrigerant compressed in the first cylinder chamber 25 pushes the first discharge valve 43 open, and is discharged from the first discharge chamber 25*b* through the first discharge port 40. The refrigerant compressed in the second cylinder chamber 26 pushes the second discharge valve 44 open, and is discharged from the second discharge chamber 26*b* through the second discharge port 41.

The first piston 8 and the first vane 32 may constitute a single component, a so-called swing piston. The second piston 28 and the second vane 33 may constitute a single component, a so-called swing piston. The first vane 32 and the second vane 33 may be coupled to the first piston 8 and the second piston 28, respectively. The specific type of the rotary compressor is not particularly limited, and a wide variety of types of rotary compressors, such as a rolling piston type rotary compressor and a swing piston type rotary compressor, can be used.

The first spring 36 and the second spring 37 are disposed behind the first vane 32 and the second vane 33, respectively. The first spring 36 and the second spring 37 push the first vane 32 and the second vane 33, respectively, toward the center of the shaft 4. The rear end of the first vane groove 34 and the rear end of the second vane groove 35 each communicate with the internal space 13 of the closed casing 1. Therefore, the pressure in the internal space 13 of the closed casing 1 is applied to the rear surface of the first vane 32 and the rear surface of the second vane 33. The oil stored in the oil reservoir 22 is supplied to the first vane groove 34 and the second vane groove 35.

As shown in FIG. 1, the first partition member 9 is attached to the second principal surface 6*a* of the upper bearing member 6 so as to form, on the opposite side to the first cylinder chamber 25 with respect to the upper bearing member 6, a refrigerant discharge space 51 capable of retaining the refrigerant discharged from the first discharge chamber 25*b* through the first discharge port 40. The first partition member 9, together with the upper bearing member 6, forms the refrigerant discharge space 51. The first discharge valve 43 is covered by the first partition member 9. An opening 9*a*, for introducing the refrigerant from the refrigerant discharge space 51 into the internal space 13 of the closed casing 1, is formed in the first partition member 9. The second partition member 10 is attached to the second principal surface 7*a* of the lower bearing member 7 so as to form, on the opposite side to the second cylinder chamber 26 with respect to the lower bearing member 7, a refrigerant discharge space 52 capable of retaining the refrigerant discharged from the second discharge chamber 26*b* through the second discharge port 41. The second partition member 10, together with the lower bearing member 7, forms the refrigerant discharge space 52. The second discharge valve 44 is covered by the second partition member 10. The refrigerant discharge spaces 51 and 52 each serve as a flow path for the refrigerant. The shaft 4 penetrates the central portion of the first partition member 9 and the central portion of the second partition member 10, and is rotatably supported by the upper bearing member 6 and the lower bearing member 7. It should be noted that in the upper bearing member 6, a bearing portion that rotatably supports the shaft 4 protrudes upward at the center of the second principal surface 6*a*.

The refrigerant discharge space 52 communicates with the refrigerant discharge space 51 via a through flow path 46 (not shown in FIG. 1). The through flow path 46 penetrates through the lower bearing member 7, the second cylinder 15, the intermediate plate 38, the first cylinder 5, and the upper bearing member 6, in a direction parallel to the rotational axis of the shaft 4. The refrigerant compressed in the second compression block 30 and the refrigerant compressed in the first compression block 3 are merged together in the internal space of the first partition member 9, that is, the refrigerant discharge space 51. Therefore, even if the volume of the refrigerant discharge space 52 is slightly smaller than the required volume, the silencing effect by the refrigerant discharge space 51 can be obtained within the first partition member 9. The cross-sectional area of the through flow path 46 (flow path area) is larger than the cross-sectional area (flow path area) of the second discharge port 41. Therefore, an increase in the pressure loss can be prevented.

As shown in FIG. 2B, in the present description, a first reference plane $H_1$, a second reference plane $H_2$, and a third reference plane $H_3$ are defined as follows. A plane including the central axis $O_1$ of the second cylinder 15 and the center of the second vane 33 when the second vane 33 protrudes maximally toward the central axis $O_1$ of the second cylinder 15 is defined as the first reference plane $H_1$. The first reference plane $H_1$ passes through the center of the second vane groove 35. A plane including the central axis $O_1$ and perpendicular to the first reference plane $H_1$ is defined as the second reference plane $H_2$. A plane including the central axis $O_1$ and the center of the second suction port 20 is defined as the third reference plane $H_3$. The central axis $O_1$ of the second cylinder 15 almost coincides with the rotational axis of the shaft 4 and the central axis of the first cylinder 5.

The second vane groove 35 has an opening that faces the second cylinder chamber 26. When the position of the center of the opening of the second vane groove 35 is defined as a reference position in the circumferential direction of the inner circumferential surface of the second cylinder 15, the first reference plane $H_1$ can be a plane passing through this reference position and including the central axis $O_1$. That is, the "center of the second vane groove 35" refers to the center of the opening of the second vane groove 35. The first reference plane $H_1$ can be a plane including the central axis $O_1$ of the second cylinder 15 and a point of contact (specifically, a tangent line) between the second cylinder 15 and the second piston 28 when the second vane 33 protrudes maximally toward the central axis $O_1$ of the second cylinder 15. The central axis $O_1$ of the second cylinder 15 specifically refers to the central axis of the cylindrical inner circumferential surface of the second cylinder 15.

In the rotary compressor 100, the level of the oil in the oil reservoir 22 is higher than the lower surface of the first cylinder 5. In order to ensure reliability, it is desirable that the level of the oil in the oil reservoir 22 be higher than the upper surface of the first cylinder 5 and lower than the lower end of the motor 2 during the operation. The second cylinder 15, the lower bearing member 7, and the second partition member 10 are immersed in the oil in the oil reservoir 22.

The refrigerant to be compressed is in a low-temperature and low-pressure state. On the other hand, the compressed refrigerant is in a high-temperature and high-pressure state. Therefore, during the operation of the rotary compressor 100, the lower bearing member 7 has a certain temperature distribution. Specifically, when the lower bearing member 7 is divided into a suction-side portion and a discharge-side portion, the former has a relatively low temperature and the latter has a relatively high temperature. When the lower bearing member 7 is divided into two parts by the first reference plane $H_1$, the suction-side portion is one part including a portion directly below the second suction port 20. The discharge-side portion is the other part having the second discharge port 41 formed therein.

In the present embodiment, the refrigerant discharge space 52 is limited so that a region where the refrigerant discharge space 52 is not present is formed on the same side as the second suction port 20 with respect to the first reference plane $H_1$, and in that region, the second principal surface 7*a* of the lower bearing member 7 is in contact with the oil in the oil reservoir 22 via the second partition member 10. Since the oil in the oil reservoir 22 is more viscous and less fluid than the refrigerant, the heat transfer coefficient on the second principal surface 7*a* is relatively low. Therefore, the amount of heat transferred from the oil to the drawn refrigerant is relatively small. In addition, it is possible to reduce the cross-sectional area of the heat transfer path through which the heat of the discharged refrigerant is transferred to the drawn refrigerant by replacing the space where the discharged refrigerant should be present in a conventional rotary compressor by a metallic material (i.e., the lower bearing member 7). In other words, in the present embodiment, the area of contact between the discharged refrigerant and the lower bearing member 7 is small. It is further possible to increase the distance over which the heat of the discharged refrigerant is transferred to the drawn refrigerant. More specifically, the heat needs to be transferred through a heat transfer path inside the lower bearing member 7 to transfer the heat from the discharged refrigerant in the refrigerant discharge space 52 to the drawn refrigerant in the second suction chamber 26*a*. In the present embodiment, the heat transfer path is relatively long. According to the Fourier's law, the amount of heat transfer is proportional to the cross-sectional area of the heat transfer path and inversely proportional to the distance of the heat transfer path. This means that the present embodiment makes it possible to increase the heat resistance of the heat transfer from the discharged refrigerant to the drawn refrigerant. Therefore, it is possible to suppress the heat transfer from the compressed refrigerant to the drawn refrigerant through the lower bearing member 7. The refrigerant discharge space 52 is described below in further detail.

As shown in FIG. 2B, when the rotary compressor 100 is divided into four segments by the first reference plane $H_1$ and the second reference plane $H_2$, and one of the four segments that includes the second suction port 20 is defined as a first quadrant segment $Q_1$. One of the four segments that includes the second discharge port 41 is defined as a second quadrant segment $Q_2$. One of the four segments that is opposite to the first quadrant segment $Q_1$ and adjacent to the second quadrant segment $Q_2$ is defined as a third quadrant segment $Q_3$. One of the four segments that is opposite to the second quadrant segment $Q_2$ and adjacent to the first quadrant segment $Q_1$ is defined as a fourth quadrant segment $Q_4$.

Figure 3:
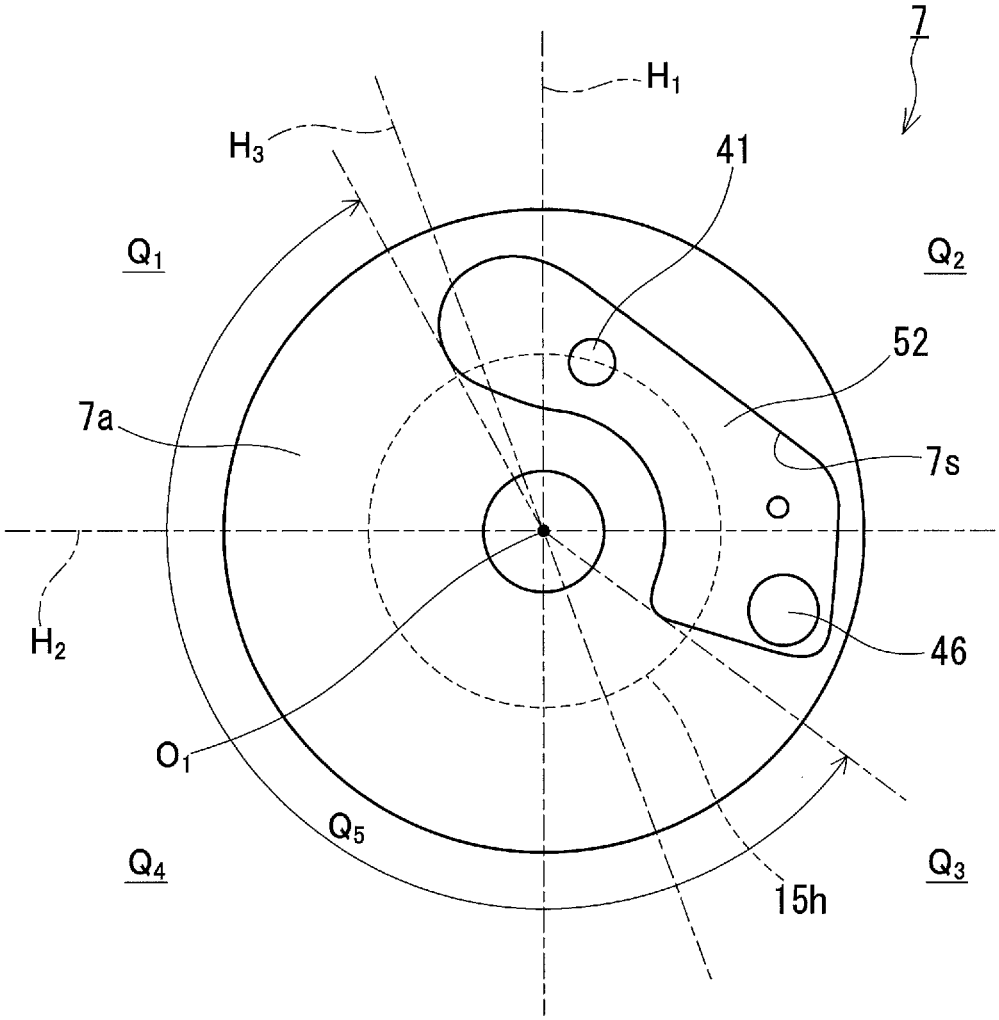
FIG. 3 is a bottom view of a lower bearing member used in the rotary compressor shown in FIG. 1.

FIG. 3 is a bottom view of the lower bearing member 7. FIG. 4 corresponds to the projection view obtained by (orthogonally) projecting the first to fourth quadrant segments $Q_1$ to $Q_4$ and the refrigerant discharge space 52 onto a plane perpendicular to the central axis $O_1$, although right and left are reversed in FIG. 3 and the projection view.

In the present embodiment, the entire refrigerant discharge space 52 falls within a combined region consisting of a region corresponding to the first quadrant segment $Q_1$, a region corresponding to the second quadrant segment $Q_2$, and a region corresponding to the third quadrant segment $Q_3$. The second principal surface 7*a* of the lower bearing member 7 is in contact with the oil in the oil reservoir 22 via the second partition member 10 over the entire extended region $Q_5$ defined by extending a region corresponding to the fourth quadrant segment $Q_4$ circumferentially around the central axis $O_1$ to the refrigerant discharge space 52.

In the present embodiment, the second principal surface 7*a* of the lower bearing member 7 is a plane of the same size as the first principal surface 7*b*, and the lower bearing member 7 is in the form of a plate with a constant thickness. A recess 7*s* extending from the second discharge port 41 in both circumferential directions along the inner circumferential surface 15*h* of the second cylinder 15 is formed in the second principal surface 7*a* of the lower bearing member 7. This recess 7*s* is closed by the second partition member 10 and thereby the refrigerant discharge space 52 is formed. That is, the second discharge port 41 opens into the recess 7*s*. From the viewpoint of providing a thermal barrier layer made of the material (usually a metal) of the lower bearing member 7 through the use of the thickness of the lower bearing member 7, it is desirable that the lower bearing member 7 has a relatively large thickness and the recess 7*s* has a depth larger than a half of the distance between the first principal surface 7*b* and the second principal surface 7*a*. The second partition member 10 includes a single plate-like member, and is in close contact with and covers the second principal surface 7*a* of the lower bearing member 7. This structure is very simple and therefore the lower bearing member 7 and the second partition member 10 can be produced inexpensively.

It is desirable that most of the refrigerant discharge space 52 be formed on the same side as the second discharge port 41 with respect to the first reference plane $H_1$. As described above, the regions corresponding to the second quadrant segment $Q_2$ and the third quadrant segment $Q_3$ correspond to the discharge-side portion having a relatively high temperature. It makes a certain amount of sense that the refrigerant discharge space 52 is formed in the second quadrant segment $Q_2$ and the third quadrant segment $Q_3$. The through flow path 46 opens into the refrigerant discharge space 52 in the third quadrant segment $Q_3$, for example. The through flow path 46 may open into the refrigerant discharge space 52 in the second quadrant segment $Q_2$.

In the present embodiment, the refrigerant discharge space 52 extends beyond the first reference plane $H_1$ and overlaps the third reference plane $H_3$. This means that a part of the refrigerant discharge space 52 is located directly below the second suction port 20. Such a configuration is not necessarily desirable in suppressing heat transfer (heat loss) from the refrigerant in the refrigerant discharge space 52 to the refrigerant in the second cylinder chamber 26. However, this configuration can be accepted for the following reason.

In a typical rotary compressor, a suction port and a discharge port are provided as close to a vane as possible in order to avoid formation of a dead volume. The refrigerant discharge space is formed below the lower bearing member, and the discharge port opens into the refrigerant discharge space. It is desirable that the refrigerant discharge space be formed only on the same side as the discharge port with respect to the first reference plane $H_1$ in order to reduce the heat loss. On the other hand, in order to reduce the pressure loss, it is desirable that there be a sufficiently large space around the discharge port. If the range of the refrigerant discharge space is limited in view of the heat loss, the space around the discharge port becomes insufficient, which may cause a significant increase in the pressure loss. That is, there is a trade-off relationship between the reduction of the heat loss and the reduction of the pressure loss.

In the present embodiment, a part of the refrigerant discharge space 52 is allowed to be located directly below the second suction port 20 for the purpose of reducing the pressure loss. The effect of reducing the heat loss can be obtained at least as long as the refrigerant discharge space 52 is not present in the region corresponding to the fourth quadrant segment $Q_4$.

From another point of view, the position of the refrigerant discharge space 52 can be determined in the following manner.

Figure 4A:
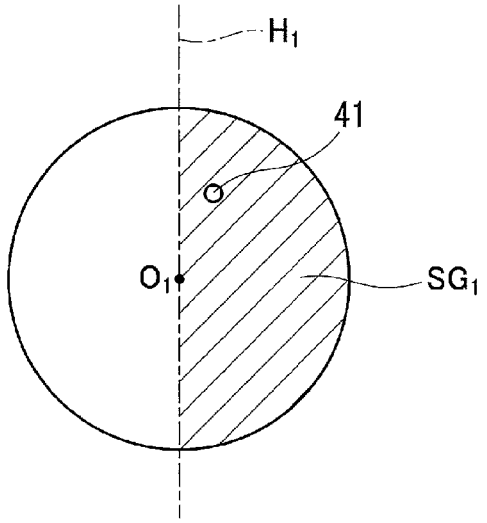
FIG. 4A is a schematic diagram illustrating another method for determining the position of a refrigerant discharge space.
Figure 4B:
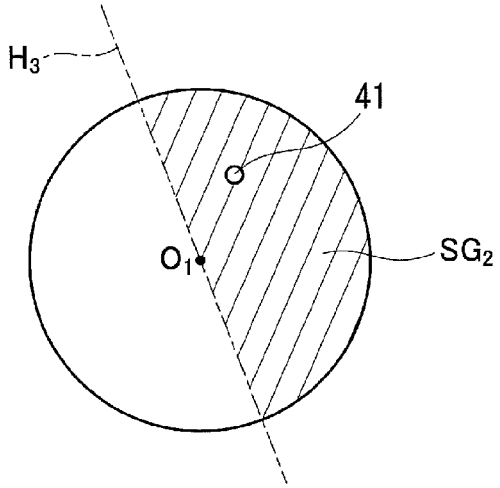
FIG. 4B is a schematic diagram illustrating another method for determining the position of the refrigerant discharge space.
Figure 4C:
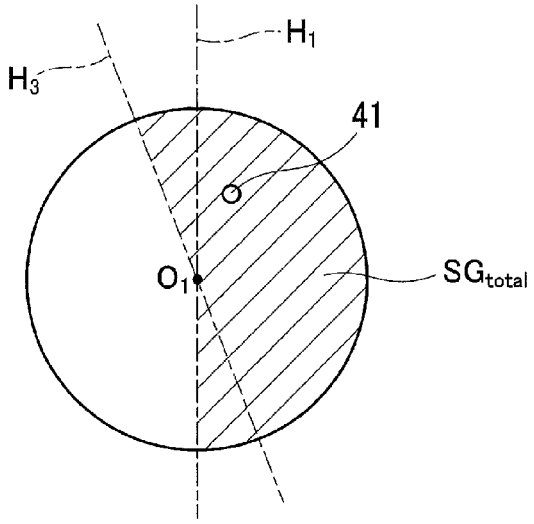
FIG. 4C is a schematic diagram illustrating another method for determining the position of the refrigerant discharge space.

As shown in FIG. 4A, the rotary compressor 100 is divided into two segments by the first reference plane $H_1$, and one of the two segments that includes the second discharge port 41 is defined as a first high-temperature segment $SG_1$ (shaded portion). As shown in FIG. 4B, the rotary compressor 100 is divided into two segments by the third reference plane $H_3$, and one of the two segments that includes the second discharge port 41 is defined as a second high-temperature segment $SG_2$ (shaded portion). As shown in FIG. 4C, the rotary compressor 100 is divided into four segments by the first reference plane $H_1$ and the third reference plane $H_3$, and three of the four segments that are included in the first high-temperature segment $SG_1$ or the second high-temperature segment $SG_2$ are collectively defined as a combined high-temperature segment $SG_{total}$ (shaded portion).

In a projection view obtained by projecting the combined high-temperature segment $SG_{total}$ and the refrigerant discharge space 52 onto a plane perpendicular to the central axis $O_1$, for example, 70% or more of the region corresponding to the refrigerant discharge space 52 may overlap the region corresponding to the combined high-temperature segment $SG_{total}$. That is, when a part of the refrigerant discharge space 52 is located directly below the second suction port 20, the total loss including the heat loss and the pressure loss is minimized, which may allow the rotary compressor 100 to exhibit the highest efficiency.

Figure 4D:
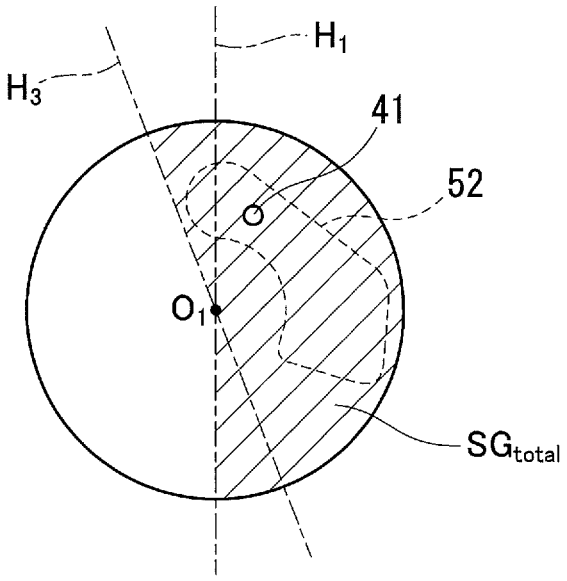
FIG. 4D is a schematic diagram showing another desired position of the refrigerant discharge space.

As shown in FIG. 4D, in a projection view obtained by projecting the combined high-temperature segment $SG_{total}$ and the refrigerant discharge space 52 onto a plane perpendicular to the central axis $O_1$, the entire region corresponding to the refrigerant discharge space 52 may fall within the region corresponding to the combined high-temperature segment $SG_{total}$. To put it more simply, the refrigerant discharge space 52 may be formed on the opposite side to the second cylinder chamber 26 with respect to the lower bearing member 7 (below the lower bearing member 7) without extending beyond the third reference plane $H_3$. With such a structure, the effect of suppressing the heat loss is enhanced. If there is no concern about an increase in the pressure loss, such a structure is reasonably acceptable.

Figure 4E:
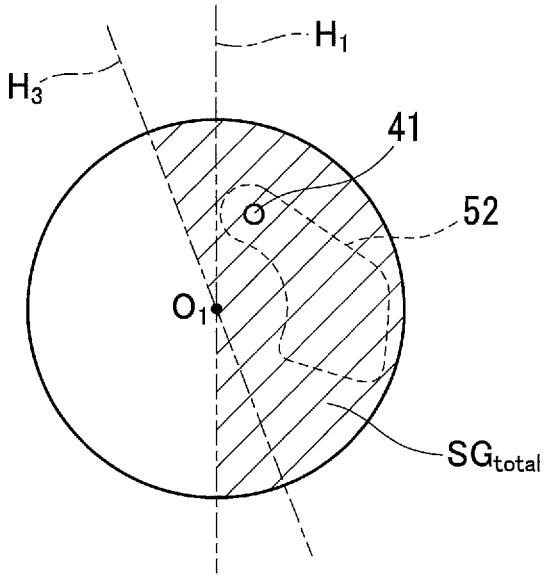
FIG. 4E is a schematic diagram showing still another desired position of the refrigerant discharge space.

In some cases, as shown in FIG. 4E, in a projection view obtained by projecting the first high-temperature segment $SG_1$ and the refrigerant discharge space 52 onto a plane perpendicular to the central axis $O_1$, the entire region corresponding to the refrigerant discharge space 52 may fall within the region corresponding to the first high-temperature segment $SG_1$. This means that the refrigerant discharge space 52 may be formed only on the same side as the second discharge port 41 with respect to the first reference plane $H_1$.

The rotary compressor 100 of the present embodiment is a vertical rotary compressor. During the operation of the rotary compressor 100, the rotational axis of the shaft 4 is parallel to the direction of gravity, and the oil reservoir 22 is formed at the bottom of the closed casing 1. During the operation of the rotary compressor 100, the upper portion of the oil in the oil reservoir 22 has a relatively high temperature and the lower portion of the oil in the oil reservoir 22 has a relatively low temperature. Therefore, according to the vertical rotary compressor 100, it is possible to obtain the full advantages of the present embodiment.

(Modifications)

Figure 5:
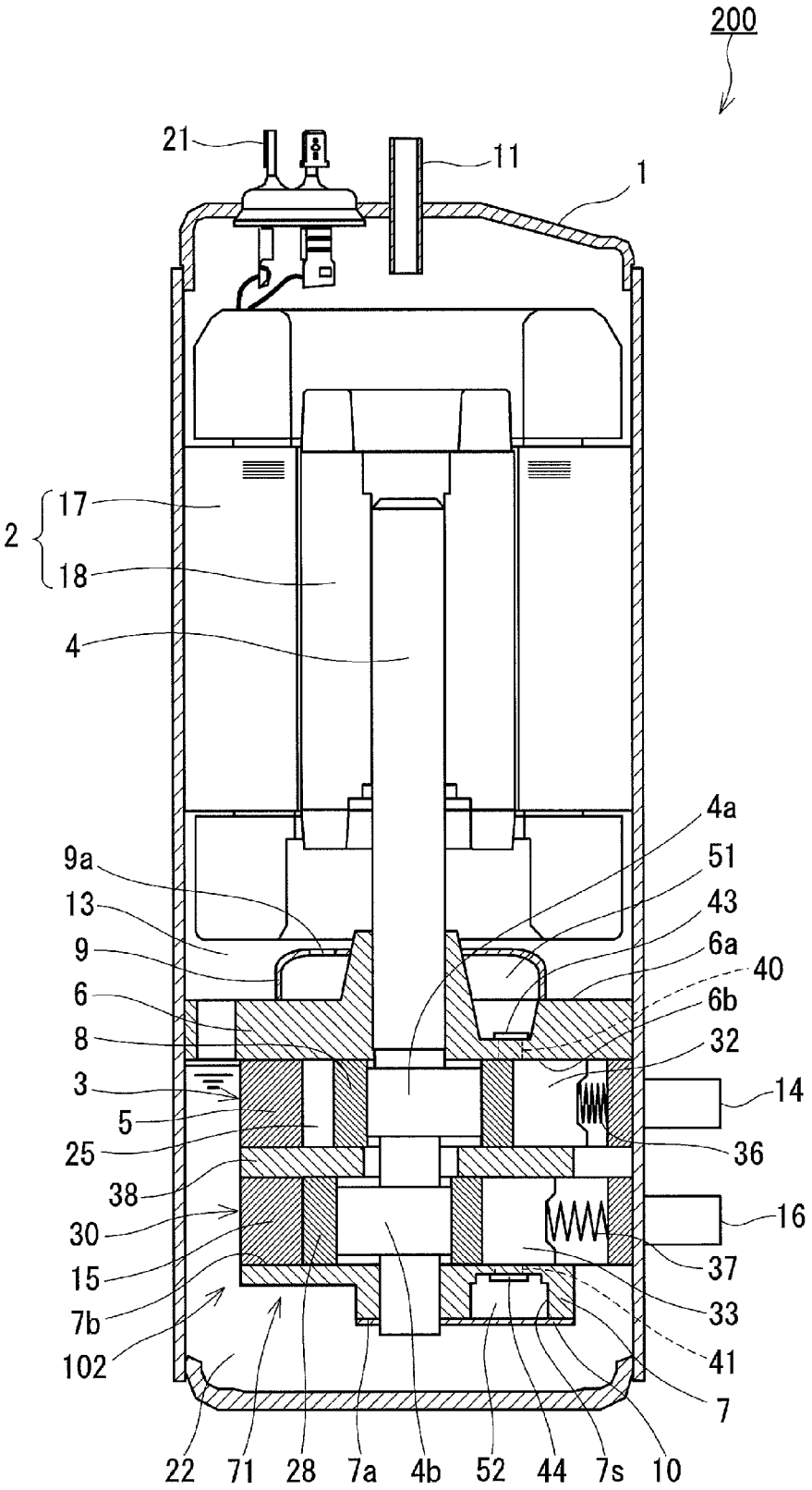
FIG. 5 is a longitudinal cross-sectional view of a rotary compressor according to a modification.
Figure 6:
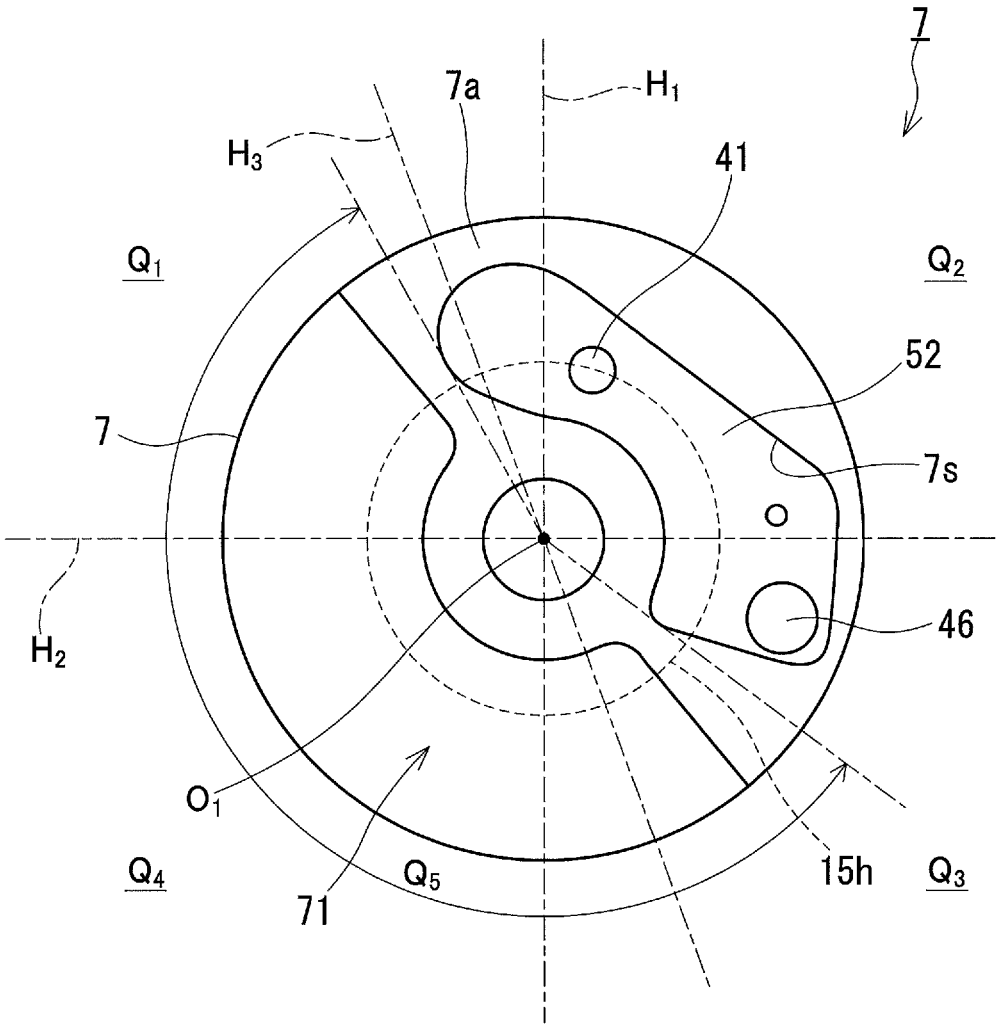
FIG. 6 is a bottom view of a lower bearing member used in the rotary compressor shown in FIG. 5.

In the embodiment described above, the second principal surface 7*a* of the lower bearing member 7 is in contact with the oil in the oil reservoir 22 via the second partition member 10 over the entire extended region $Q_5$. However, the second principal surface 7*a* of the lower bearing member 7 may be in direct contact with the oil in the oil reservoir 22 in the entire extended region $Q_5$ or a part thereof. For example, as in a rotary compressor 200 of a modification shown in FIG. 5 and FIG. 6, a fan-shaped cutout 71 may be provided in the second principal surface 7*a* of the lower bearing member 7 on the opposite side to the refrigerant discharge space 52 with respect to the central axis $O_1$ so that the cutout 71 and the refrigerant discharge space 52 are spaced from each other with a partition wall interposed therebetween, and thereby the second partition member 10 may cover a part of the second principal surface 7*a* of the lower bearing member 7 other than the part corresponding to the cutout 71. Alternatively, even in the case where the cutout 71 is provided in the second principal surface 7*a* of the lower bearing member 7, the second partition member 10 may be formed in a recessed shape conforming to the shape of the cutout 71, and thereby the second partition member 10 may cover the entire second principal surface 7*a* of the lower bearing member 7. The cutout 71 thus formed reduces the thickness of the lower bearing member 7. In this case, the weight of the lower bearing member 7 is reduced.

(Second Embodiment)

Figure 7:
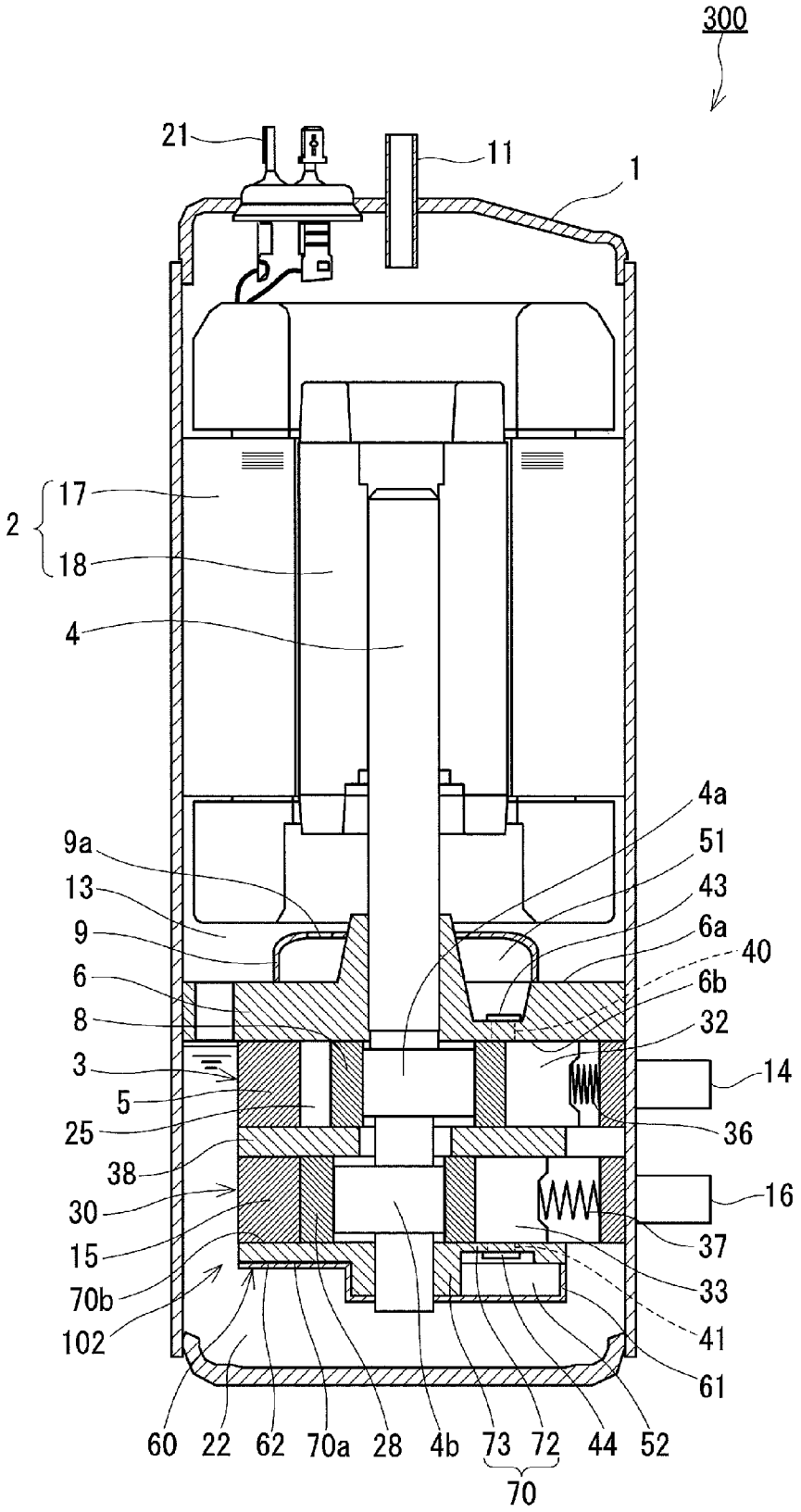
FIG. 7 is a longitudinal cross-sectional view of a rotary compressor according to a second embodiment of the present invention.
Figure 8:
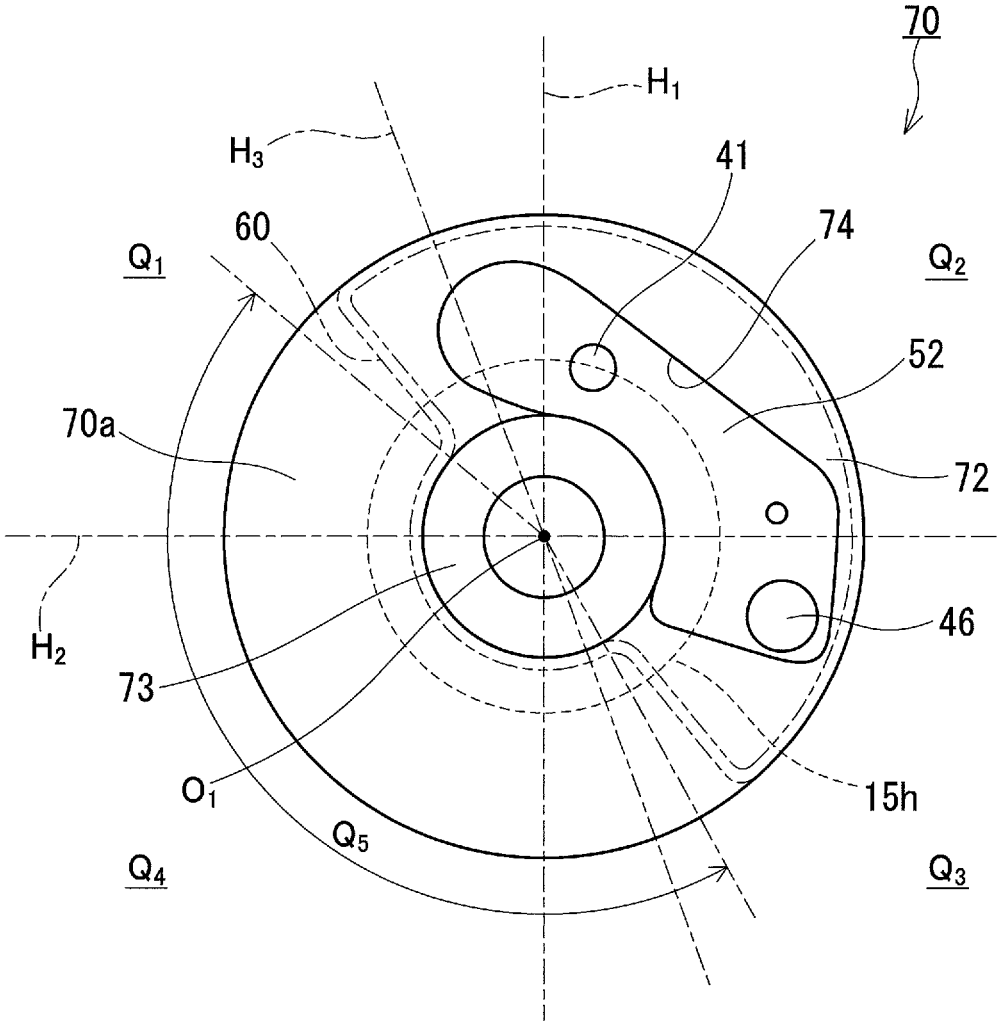
FIG. 8 is a bottom view of a lower bearing member used in the rotary compressor shown in FIG. 7.

Next, a rotary compressor 300 according to the second embodiment of the present invention is described with reference to FIG. 7 and FIG. 8. In the present embodiment, the same components as those in the first embodiment are denoted by the same reference numerals, and the description thereof is omitted.

In the present embodiment, the rotary compressor 300 includes a lower bearing member 70 and a second partition member 60. The rotary compressor 300 and the rotary compressor 100 shown in FIG. 1 have the same fundamental structure required to compress a refrigerant.

The lower bearing member 70 is disposed below the second cylinder 15 so as to form the second cylinder chamber 26 between the inner circumferential surface of the second cylinder 15 and the outer circumferential surface of the second piston 28. More specifically, the lower bearing member 70 is attached to the lower surface of the second cylinder 15. The lower bearing member 70 is composed of a circular plate portion 72 and a bearing portion (protruding portion) 73. The circular plate portion 72 is a thin flat portion adjacent to the second cylinder 15, and defines a first principal surface 70*b* of the lower bearing member 70 that is in contact with the second cylinder 15 and a second principal surface 70*b* of the lower bearing member 70 that is opposite to the first principal surface 70*b* and parallel to the first principal surface 70*b*. The bearing portion 73 protrudes downward at the center of the circular plate portion 72. The second discharge port 41 is formed in the circular plate portion 72. The second discharge valve 44 that opens and closes the second discharge port 41 is attached to the circular plate portion 72. In the present embodiment, a stepped portion 74 forming a recess in a region including the discharge port 41 and the through flow path 46 is provided on the second principal surface 70*a* defined by the circular plate portion 72. The bearing portion 73 is a cylindrical portion that is formed integrally with the circular plate portion 72 so as to support the shaft 4.

The second partition member 60 is a member of a bowl-shaped structure, and is attached to the second principal surface 70*a* of the lower bearing member 70 so as to form the refrigerant discharge space 52 on the opposite side to the second cylinder chamber 26. More specifically, the second partition member 60 has a shape enclosing the second discharge port 41 together with a space facing the second principal surface 70*a* of the lower bearing member 70, and the space enclosed by the lower bearing member 70 and the second partition member 60 constitutes the refrigerant discharge space 52. The second partition member 60 also covers the bearing portion 73, and a through hole for exposing the lower end of the shaft 4 to the oil reservoir 22 is formed at the center of the second partition member 60.

Also in the present embodiment, as in the first embodiment, the entire refrigerant discharge space 52 falls within the combined region consisting of the region corresponding to the first quadrant segment $Q_1$, the region corresponding to the second quadrant segment $Q_2$, and the region corresponding to the third quadrant segment $Q_3$. The second principal surface 70*a* of the lower bearing member 70 is in contact with the oil in the oil reservoir 22 via the second partition member 10 over the entire extended region $Q_5$ defined by extending the region corresponding to the fourth quadrant segment $Q_4$ circumferentially around the central axis $O_1$ to the refrigerant discharge space 52.

The second partition member 60 is composed of a bowl-shaped portion 61 and a flange portion 62. The bowl-shaped portion 61 and the flange portion 62 constitute a single component. The bowl-shaped portion 61 has a fan shape larger than that of the stepped portion 74 in plane view, and is composed of a bottom wall and a peripheral wall. The bottom wall covers a specific portion including the stepped portion 74 (for example, about a half) in the second principal surface 70*a* with a space between the specific portion and the bottom wall. The peripheral wall extends upwardly from the periphery of the bottom wall. In the present embodiment, the bearing portion 73 of the lower bearing member 70 is contained in the bowl-shaped portion 61, the bottom wall of the bowl-shaped portion 61 is in close contact with the lower surface of the bearing portion 73, and the peripheral wall of the bowl-shaped portion 61 is in close contact with about a half of the outer circumferential surface of the bearing portion 73. The flange portion 62 is in close contact with and covers the remaining part of the second principal surface 7*a*.

According to the configuration of the present embodiment, it is possible to limit the refrigerant discharge space 52 and to allow the second principal surface 70*a* of the lower bearing member 70 to be in contact with the oil in the oil reservoir 22 via the second partition member 60 in at least the entire region corresponding to the fourth quadrant segment $Q_4$, while the lower bearing member 70 having the same structure as the lower bearing member of a conventional rotary compressor is used. In addition, heat transfer from the oil in the oil reservoir 22 to the refrigerant in the second cylinder chamber 26 can be suppressed more effectively by the flange portion 62.

(Other Embodiments)

The rotary compressor of the present invention need not necessarily be a two-stage rotary compressor. The present invention can also be applied to single-stage rotary compressors such as a rotary compressor obtained by removing the first compression block 3 from each of the rotary compressors 100, 200, and 300 shown in FIGS. 1, 5, and 7.

Figure 9:
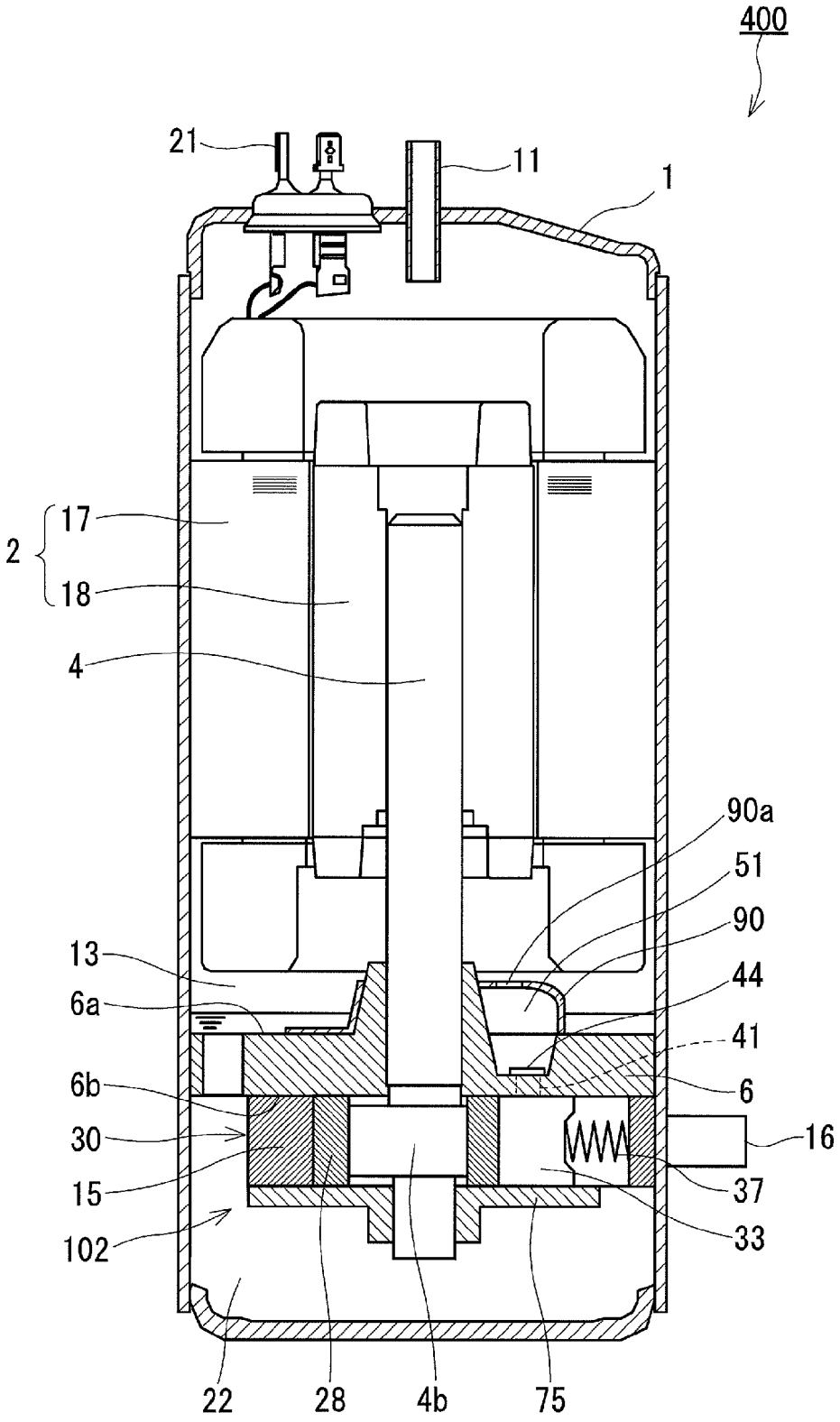
FIG. 9 is a longitudinal cross-sectional view of a rotary compressor according to still another embodiment of the present invention.

Alternatively, the bearing member of the present invention may be the upper bearing member 6 disposed above the cylinder 15, as in a rotary compressor 400 shown in FIG. 9. A partition member 90 is attached to the second principal surface 6*a* of the upper bearing member 6 so as to form, above the upper bearing member 6, the refrigerant discharge space 51 capable of retaining the refrigerant discharged from the discharge chamber 25*b* through the discharge port 41. An opening 90*a*, for introducing the refrigerant from the refrigerant discharge space 51 into the internal space 13 of the closed casing 1, is formed in the partition member 90. No discharge port is formed in the lower bearing member 75.

A recess into which the discharge port 41 opens is formed in the second principal surface 6*a* of the upper bearing member 6. This recess constitutes the lower half of the refrigerant discharge space 51. The partition member 90 bulges upwardly beyond the oil level in the oil reservoir 22 at a position corresponding to the recess so as to constitute the upper half of the refrigerant discharge space 51, but the other part of the partition member 90 is in close contact with the upper bearing member 6. The refrigerant discharge space 51 falls within the combined region consisting of the region corresponding to the first quadrant segment $Q_1$, the region corresponding to the second quadrant segment $Q_2$, and the region corresponding to the third quadrant segment $Q_3$. The second principal surface 6*a* of the upper bearing member 6 is in contact with the oil in the oil reservoir 22 directly or via the partition member 90 over the entire extended region $Q_5$ defined by extending the region corresponding to the fourth quadrant segment $Q_4$ circumferentially around the central axis $O_1$ to the refrigerant discharge space 51.

The advantageous effects of the present invention can also be obtained in the configuration as shown in FIG. 9. It should be noted that if the bearing member of the present invention is a lower partition member disposed below the cylinder, as shown in the first and second embodiments, thermal stratification in the oil reservoir 22 in which the temperature of the oil decreases in the lower layers can be reasonably used, and therefore the advantageous effects of the present invention can be obtained more significantly.

INDUSTRIAL APPLICABILITY

The present invention is useful for compressors of refrigeration cycle apparatuses that can be used in electrical appliances such as hot water dispensers, hot water heaters, and air conditioners.

The invention claimed is:

1. A rotary compressor comprising:

a closed casing comprising an oil reservoir;

a cylinder disposed inside the closed casing so as to be immersed in the oil reservoir;

a piston disposed inside the cylinder;

a bearing member disposed below the cylinder so as to form a cylinder chamber between the cylinder and the piston, the bearing member having a first principal surface that is in contact with the cylinder and a second principal surface that is opposite to the first principal surface;

a vane that partitions the cylinder chamber into a suction chamber and a discharge chamber;

a suction port through which a refrigerant to be compressed is introduced into the suction chamber;

a discharge port through which the compressed refrigerant is discharged from the discharge chamber, the discharge port being formed in the bearing member; and a partition member attached to the second principal surface of the bearing member so as to form, together with the bearing member, a refrigerant discharge space that retains the refrigerant discharged from the discharge chamber through the discharge port, wherein when (i) a plane including a central axis of the cylinder and a center of the vane when the vane protrudes maximally toward the central axis of the cylinder is defined as a first reference plane, (ii) a plane including the central axis and perpendicular to the first reference plane is defined as a second reference plane, and (iii) four segments obtained by dividing the rotary compressor by the first reference plane and the second reference plane are defined as a first quadrant segment including the suction port, a second quadrant segment including the discharge port, a third quadrant segment opposite to the first quadrant segment and adjacent to the second quadrant segment, and a fourth quadrant segment opposite to the second quadrant segment and adjacent to the first quadrant segment, respectively, the refrigerant discharge space falls within a combined region consisting of a region corresponding to the first quadrant segment, a region corresponding to the second quadrant segment, and a region corresponding to the third quadrant segment, the second principal surface of the bearing member is in contact with an oil in the oil reservoir directly or via the partition member over an extended region defined by extending a region of the bearing member corresponding to the fourth quadrant segment circumferentially around the central axis to the refrigerant discharge space, a recess extending from the discharge port in both circumferential directions along an inner circumferential surface of the cylinder is formed in the second principal surface of the bearing member, the discharge port opens into the recess, the recess is closed by the partition member and thereby the refrigerant discharge space is formed, a thermal barrier layer including a metal of the bearing member is formed in the extended region of the bearing member, and the thermal barrier layer has a constant thickness.

2. The rotary compressor according to claim 1, wherein the recess has a depth larger than a half of a distance between the first principal surface and the second principal surface.

3. The rotary compressor according to claim 2, wherein the partition member comprises a single plate-like member.

4. The rotary compressor according to claim 1, wherein the bearing member is disposed below the cylinder and includes a circular plate portion that defines the first principal surface and the second principal surface and a protruding portion that protrudes downward at a center of the circular plate portion, and the partition member has a shape enclosing the discharge port together with a space facing the second principal surface of the bearing member, and the space enclosed by the bearing member and the partition member constitutes the refrigerant discharge space.

5. The rotary compressor according to claim 1, wherein when (a) a plane including the central axis and a center of the suction port is defined as a third reference plane, (b) one of two segments obtained by dividing the rotary compressor by the first reference plane is defined as a first high-temperature segment including the discharge port, (c) one of two segments obtained by dividing the rotary compressor by the third reference plane is defined as a second high-temperature segment including the discharge port, and (d) three of four segments obtained by dividing the rotary compressor by the first reference plane and the third reference plane are collectively defined as a combined high-temperature segment, the three segments are included in the first high-temperature segment or the second high-temperature segment, and in a projection view obtained by projecting the combined high-temperature segment and the refrigerant discharge space onto a plane perpendicular to the central axis, 70% or more of a region corresponding to the refrigerant discharge space overlaps a region corresponding to the combined high-temperature segment.

6. The rotary compressor according to claim 1, further comprising a shaft to which the piston is fitted, wherein the rotary compressor is a vertical rotary compressor in which a rotational axis of the shaft is parallel to a direction of gravity and the oil reservoir is formed at a bottom of the closed casing.

7. The rotary compressor according to claim 1, wherein the refrigerant discharge space is also located directly below the suction port.

* * * * *